US005819821A

United States Patent [19]

Giacomelli

[11] Patent Number: 5,819,821

[45] Date of Patent: Oct. 13, 1998

[54] FILL SYSTEM INCLUDING A FLEXIBLE NOZZLE FOR REDUCING THE MIXING OF PRODUCT AND AIR DURING CONTAINER FILLING

[75] Inventor: Peter Giacomelli, Buffalo Grove, Ill.

[73] Assignee: Tetra Laval Holdings & Finance, S.A., Pully, Switzerland

[21] Appl. No.: 691,747

[22] Filed: Aug. 1, 1996

[51] Int. Cl.[6] ..... B67C 3/26; B67C 3/34

[52] U.S. Cl. ..... 141/263; 141/148; 141/152; 141/172; 141/114; 141/255; 141/270; 141/275; 141/318; 141/374

[58] Field of Search ..... 141/148, 149, 141/152, 172, 114, 251, 255, 263, 266, 270, 275, 318, 374, 375; 239/DIG. 12, 602; 222/490, 494; 277/197

[56] References Cited

U.S. PATENT DOCUMENTS

| | | | |
|---|---|---|---|
| Re. 27,399 | 6/1972 | Urso . | |
| 872,161 | 11/1907 | Whitehorn | 141/275 |
| 996,588 | 6/1911 | Kennedy . | |
| 1,704,527 | 3/1929 | Becker . | |
| 1,884,213 | 10/1932 | Pratt . | |
| 1,923,501 | 8/1933 | Perry . | |
| 2,605,784 | 8/1952 | Snider . | |
| 2,644,663 | 7/1953 | Klingler . | |
| 2,822,819 | 2/1958 | Geeraert . | |
| 3,096,914 | 7/1963 | Kerr . | |
| 3,118,468 | 1/1964 | Bochan . | |
| 3,195,586 | 7/1965 | Vogt . | |
| 3,308,798 | 3/1967 | Snider . | |
| 3,324,906 | 6/1967 | Chu | 222/490 |
| 3,451,419 | 6/1969 | Coleman . | |
| 3,589,392 | 6/1971 | Meyer . | |
| 3,595,266 | 7/1971 | Brookman . | |
| 3,726,436 | 4/1973 | Despain et al. . | |
| 3,957,078 | 5/1976 | Hlinsky . | |
| 4,109,836 | 8/1978 | Falarde . | |
| 4,178,638 | 12/1979 | Meyer . | |
| 4,341,239 | 7/1982 | Atkinson . | |
| 4,482,276 | 11/1984 | Chouinard . | |
| 4,709,836 | 12/1987 | Andersen . | |
| 4,877,160 | 10/1989 | Derving . | |
| 5,052,594 | 10/1991 | Sorby . | |
| 5,105,997 | 4/1992 | Wakabayashi et al. . | |
| 5,300,033 | 4/1994 | Miller . | |
| 5,309,961 | 5/1994 | Franke et al. . | |
| 5,469,897 | 11/1995 | Haytner et al. | 141/386 |

*Primary Examiner*—David J. Walczak
*Assistant Examiner*—Timothy L. Maust
*Attorney, Agent, or Firm*—Michael A. Catania

[57] ABSTRACT

A filling system of a packaging machine is set forth that reduces the mixing of product and air during the filling of a container with a product. The filling system is designed to fill a container having a cross section defined by a plurality of sidewalls, an interior bottom engaging the sidewalls, and an open top. The system includes a fill pump for pumping a liquid product and a fill pipe, the fill pipe having an inlet receiving liquid under pressure from the fill pump and an outlet overlying the container. A nozzle is disposed over the outlet end of the fill pipe. The nozzle comprises a collar for connecting the nozzle to the outlet end of the fill pipe and a plurality of flaps formed from a flexible material extending from the collar. The plurality of flaps are preferably biased to a closed position, such as under their own resilience. The nozzle seals the outlet end of the fill pipe when in this closed position. A mechanism for relatively moving the container and nozzle toward one another to a first position in which the nozzle is disposed in the interior bottom of the container and a second position in which the nozzle is disposed distal from the interior bottom of the container is also utilized. In operation, the fill pump pumps the liquid product through the fill pipe under pressure when the container and nozzle are disposed in their relative first position to thereby urge the flaps of the nozzle from the closed position to an open position, for example, by influence of the liquid product pressure. The flaps of the nozzle are dimensioned to substantially conform and engage with the sidewalls of the container when the flaps are urged to the open position to thereby inhibit mixing of air and product as the liquid product is dispensed into the container through the nozzle and as the moving mechanism is operated to relatively move the container and nozzle from the first position to the second position.

27 Claims, 9 Drawing Sheets

FILL SYSTEM INCLUDING A FLEXIBLE NOZZLE FOR REDUCING THE MIXING OF PRODUCT AND AIR DURING CONTAINER FILLING

FIELD OF THE INVENTION

The present invention relates to a method and apparatus for filling containers, and more particularly, to a filling system including a corresponding nozzle for a packaging machine that reduces mixing of product and air during filling of the container.

BACKGROUND

Packaging machines are known that integrate the various components necessary to fill and seal a container into a single machine unit. This packaging process, generally stated, includes feeding carton blanks into the machine, sealing the bottom of the cartons, filling the cartons with the desired contents, sealing the tops of the cartons, and then off loading the filled cartons for shipping.

Trends within the field of packaging machines point toward increasingly high capacity machines intended for rapid, continuous filling and sealing of a very large number of identical or similar packaging containers, e.g., containers of the type intended for liquid contents such as milk, juice, and the like. One such machine is disclosed in U.S. Pat. No. 5,488,812, issued Feb. 6, 1996, and entitled "Packaging Machine". The machine disclosed in the '812 patent includes a plurality of processing stations, each station implementing one or more processes to form, fill, and seal the containers. Each of the processing stations is driven by one or more servomotors that drive the various components of each of the processing stations.

The increased throughput and decreased size requirements of packagers on their packaging machines have increased the demands that are placed on the fill systems that are employed. Various apparatus and corresponding methods for filling containers, such as gable-top containers, have therefor been devised for these machines. In accordance with one of the more popular filling methods, the container is lifted from a conveyor to a fill pipe by means of a lifting mechanism. The container lifting mechanism gradually lowers the container as product is dispensed through the fill tube. The container then again engages the conveyor where it is transported to a top sealing station. Such a method is utilized in TR/7™ and TR/8™ packaging machines manufactured and available from Tetra Pak, Inc.

Alternatively, the filling and top sealing operations may be performed at a single location within the machine. In such instances, the container may be top sealed after it has been lowered from the fill pipe. Such a method and apparatus are shown and described in the foregoing '812 patent, and, further, in U.S. Ser. No. 08/315,414, filed Sep. 28, 1994, and entitled "Control System For A Packaging Machine".

One problem encountered when attempting to increase the speed with which a container is filled with product relates to the foaming that occurs as a result of air and product mixing in the container. Generally stated, foaming increases as the speed with which the container is filled increases. When foaming is excessive, the product splashes into the sealing areas of the container resulting in improper sealing in subsequent sealing operations and/or contamination of the sealing area resulting in a reduction in the hygiene of the seal than would other wise be obtained. The rate at which the container may be filled is thus limited by the foaming that occurs for a given fill rate.

SUMMARY OF THE INVENTION

A filling system of a packaging machine is set forth that reduces the mixing of product and air during the filling of a container with a product. The filling system is designed to fill a container having a cross section defined by a plurality of sidewalls, an interior bottom engaging the sidewalls, and an open top. The system includes a fill pump for pumping a liquid product and a fill pipe, the fill pipe having an inlet receiving liquid under pressure from the fill pump and an outlet overlying the container. A nozzle is disposed over the outlet end of the fill pipe. The nozzle comprises a collar for connecting the nozzle to the outlet end of the fill pipe and a plurality of flaps formed from a flexible material extending from the collar. The plurality of flaps are preferably biased to a closed position, such as under their own resilience. The nozzle seals the outlet end of the fill pipe when in this closed position. A mechanism for relatively moving the container and nozzle toward one another to a first position in which the nozzle is disposed in the interior bottom of the container and a second position in which the nozzle is disposed distal from the interior bottom of the container is also utilized. In operation, the fill pump pumps the liquid product through the fill pipe under pressure when the container and nozzle are disposed in their relative first position to thereby urge the flaps of the nozzle from the closed position to an open position, for example, by influence of the liquid product pressure. The flaps of the nozzle are dimensioned to substantially conform and engage with the sidewalls of the container when the flaps are urged to the open position to thereby inhibit mixing of air and product as the liquid product is dispensed into the container through the nozzle and as the moving mechanism is operated to relatively move the container and nozzle from the first position to the second position.

Other arrangements for opening and closing the uniquely designed nozzle are also contemplated. For example, a downwardly movable cylindrical plunger having an aperture through which the product may flow may be urged against the flaps from the fill pipe to move them to their open state. Still further, the flaps may be provided with electrically sensitive supports disposed therein or thereon that change shape in response to an electrical stimulus to thereby urge the flaps to their open and/or closed states.

Various container cross-sections are contemplated for filling using the disclosed system. In accordance with one embodiment of the nozzle, the nozzle is designed to conform to a container having a generally square cross-section. In accordance with another embodiment, the nozzle is designed to conform to a generally rectangular container.

Other advantages of the present invention will become apparent upon reading the following detailed description and appended claims, and upon reference to the accompanying drawings.

DETAILED DESCRIPTION OF THE PREFERRED EMBODIMENT

Figure 1:
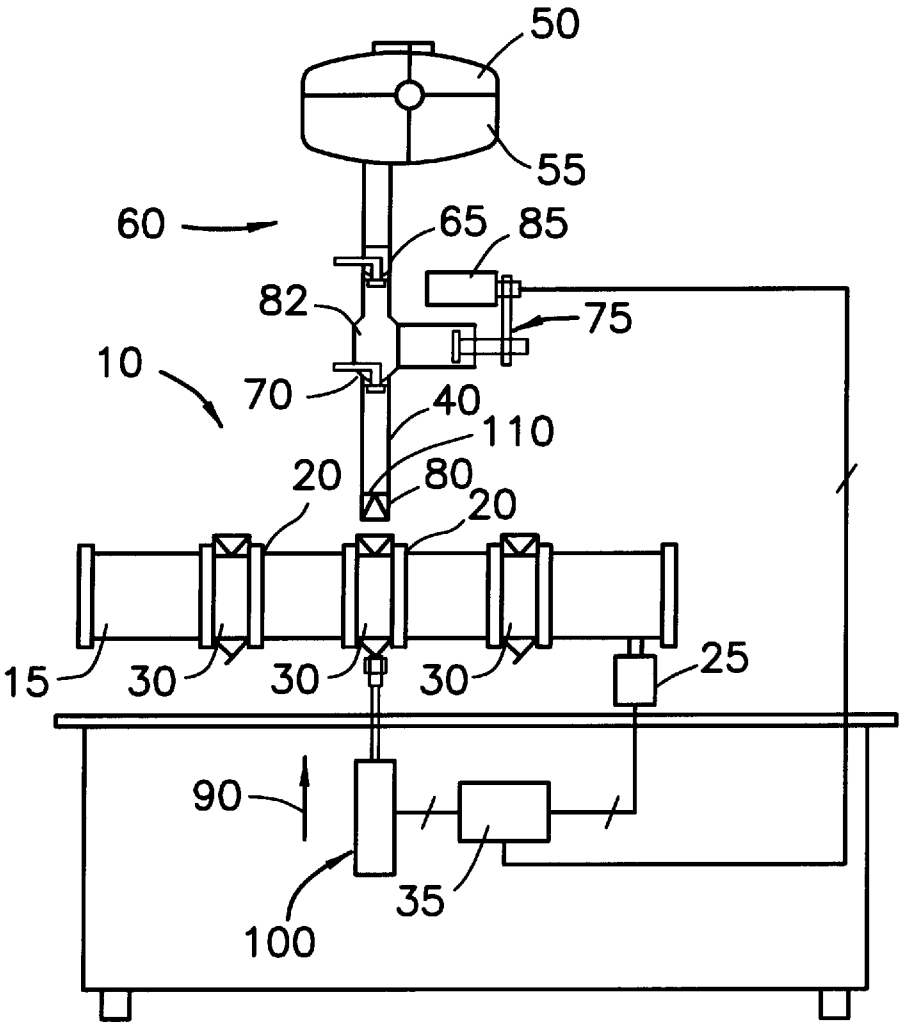
FIG. 1 is a schematic view of a typical filling machine that may incorporate the presently disclosed fill system.

FIG. 1 is a partial diagrammatic view of one of the many types of filling machines that may utilize a filling system, shown generally at 10, constructed and operated in the manner described herein. As shown in FIG. 1, a conveyor 15 having a plurality of container support members 20 is driven, for example, by a motor 25, such as a servomotor. The support members 20 each support a single, open topped container 30 that has its bottom sealed. The conveyor 15 is driven by motor 25 under the control of, for example, a programmable control system 35, or the like, to present the containers 30 successively below a fill pipe 40 of the fill system 10.

A storage or balance tank 50 containing a liquid product 55 is connected to provide a flow of the liquid product through a flow control system 60. The flow control system 60, generally stated, comprises an inlet valve 65, an outlet valve 70, a pump mechanism 75, the fill pipe 40, and a nozzle 80. The inlet and outlet valves 65 and 70 are operated to control the flow of the liquid product into and from the pump chamber 82 of the pump mechanism 75. The pump mechanism 75 may be any type of pump mechanism, such as one disclosed in U.S. Pat. No. 4,877,160, which patent is incorporated by reference. The pump mechanism 75 may be driven, for example, by a servomotor 85 under the direction of the programmable control system 35. As illustrated, the containers 30 are successively brought below the nozzle 80 for filling with the liquid product. To this end, each container 30 is lifted in the direction of arrow 90 so that the nozzle 80 is disposed in the interior of the container. This lifting may be done using a lifting mechanism 100 that executes a motion profile under the direction of, for example, the programmable control system 35. One such lifter mechanism and corresponding carton gripping mechanism are disclosed in U.S. Ser. No. 08/315,410, filed Sep. 28, 1994 and U.S. Ser. No. 08/315,410, also filed Sep. 28, 1994. The flow control system 60 is then operated to fill the container 30 with liquid product as the container 30 is lowered from the nozzle 80 by the lifting mechanism 100, preferably maintaining the nozzle 80 below the level of the liquid throughout this downward motion. Even more preferably, the flaps 130 are maintained approximately 2–3 mm below the surface of the liquid being dispensed.

The nozzle 80 is disposed over the outlet 110 of the fill pipe 40. The nozzle 80 includes a plurality of flaps which are made of a flexible material, such as FDA approved silicone or the like. The flaps are flexible between an open position in which the liquid product is allowed to flow therefrom and a closed position in which the nozzle seals the outlet end 110 of the fill pipe 40. The flaps are biased to a closed position, for example, by virtue of their inherent resiliency or by a separate mechanical biasing element. Movement of the flaps to their open position may ensue by virtue of the pressure of the liquid against the inherent resiliency or through a separate mechanical opening element.

Figure 2:
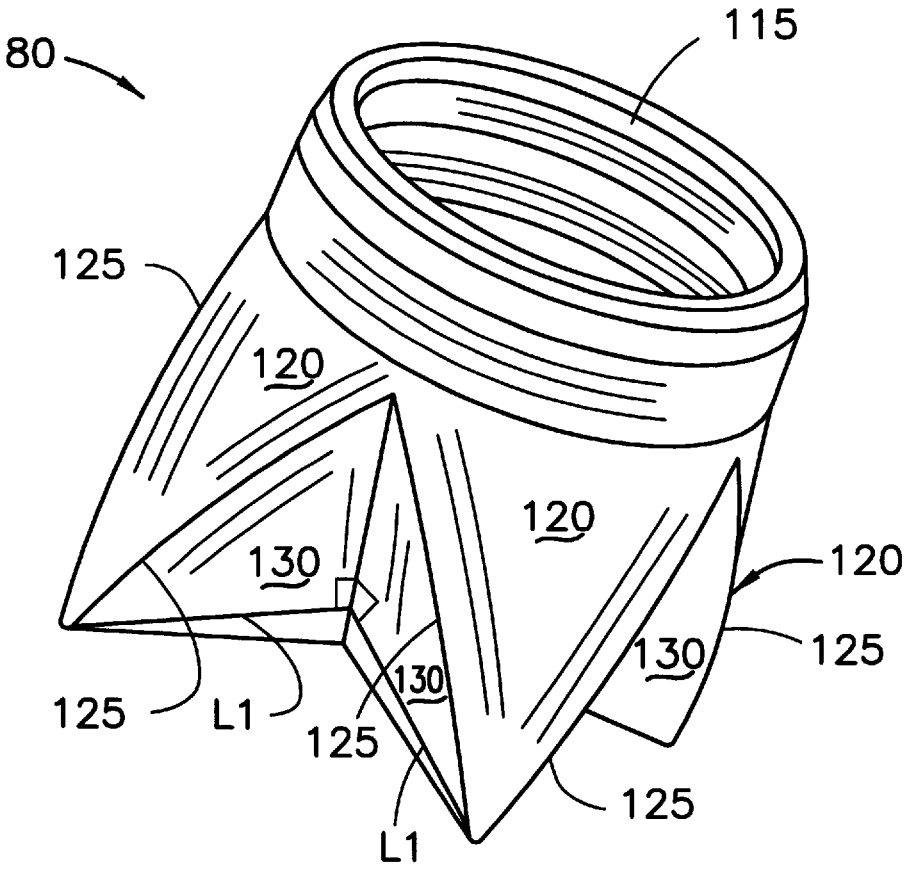
FIG. 2 is a perspective view of one embodiment of a filling nozzle suitable for use in the exemplary system of FIG. 1.
Figure 3:
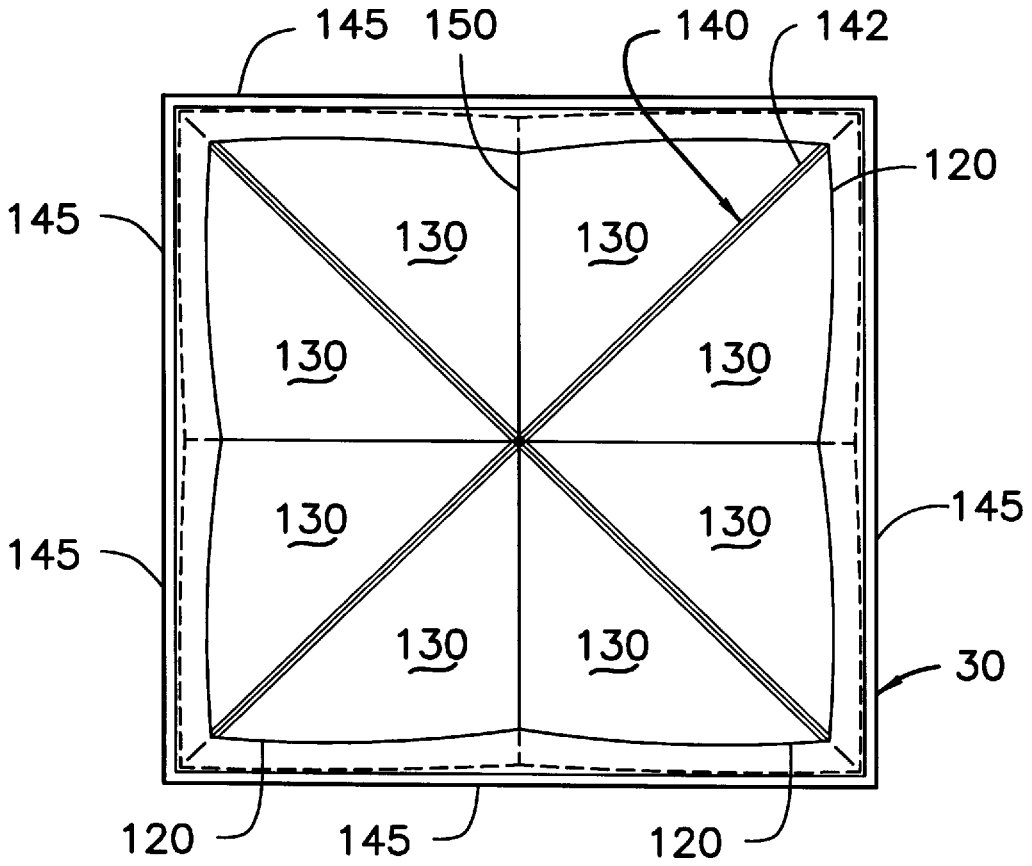
FIG. 3 is a top view of the filling nozzle of FIG. 2.

FIG. 2 is a perspective view of one embodiment of the nozzle 80 while FIG. 3 is a top view of the same. As illustrated, the nozzle 80 has a collar 115 that is sized for connection to the fill pipe 40. The nozzle 80 has a plurality of flaps that extend from the collar 115. In the embodiment shown, the plurality of flaps comprise four, V-shaped lugs 120 that are disposed, for example, at about 90 degrees from one another. Each V-shaped lug 120 is defined by side edges 125. Inwardly extending flaps 130 extend between opposed edges 125 of adjacent, V-shaped lugs. The measurement denoted by L1 as the perpendicular line between the vertices of the V-shaped lugs 120 and the fold defining the inwardly extending flaps 130 is preferably substantially equal to one half of the length of a sidewall of the container for which the nozzle is designed to fill. The inwardly extending flaps 130 join together in the closed position illustrated to form a cross-shaped, sealed slit 140. The inwardly extending flaps 130 are preferably biased under the influence of their inherent resiliency to the closed position illustrated. An angled sealing lip 142 may be disposed along the inner edge of the inwardly extending flaps 130 to facilitate sealing when in the closed position. The pump mechanism 75 may be used to provide a slight back pressure to increase the integrity of the seal of the flaps in the closed position.

The phantom lines of FIG. 3 illustrate the positions of the V-shaped lugs 120 and inwardly extending flaps 130 in the open state of the nozzle 80. As illustrated, the inwardly extending flaps 130 and V-shaped lugs 120 now extend outward so that the lower edges of the opened nozzle conform to a generally square cross-section and engage the sidewalls 145 of the container 30. Opening of the flaps 130 to the illustrated position may take place by generating a slight overpressure in the fill tube 40 that acts against the inherent resiliency that biases the flaps to the closed position. Alternative manners of opening the nozzle are likewise contemplated. For example, a mechanism applying a force against the fold ridges 150 may be utilized, such as a downwardly movable cylindrical plunger (not shown) having an aperture through which the product may flow. Preferably, the vertices of the V-shaped lugs 120 flare to engage interior corner portions of the container. Such flaring may be generated in accordance with any of the foregoing methods for opening the nozzle. Where the nozzle is opened solely using an overpressure of the liquid product, the nozzle is preferably maintained below the liquid level of the product and the overpressure creates an upward force against the flaps of the nozzle to thereby cause the flaps to flare outwardly against the sidewalls of the container.

It shall be understood that the nozzle 80 may be made from any suitable flexible material such as soft plastic or rubber of a suitable hardness. In the case of packaging foodstuffs, the nozzle may more preferably be made from FDA approved nitrile, silicone rubber, or the like.

The dimensions of the nozzle 80 in the open state are of particular importance in connection with the present system. In the embodiment illustrated in FIGS. 2–6, the lower portion of the nozzle 80 flares to define a generally square cross-section. With reference to FIGS. 2–6, the cross-section of the lower portion of the nozzle 80 is designed to conform with the cross-section of the container 30 as defined by the sidewalls 145 of the container 30 when the flaps of the nozzle 80 are in the open state.

Figure 4:
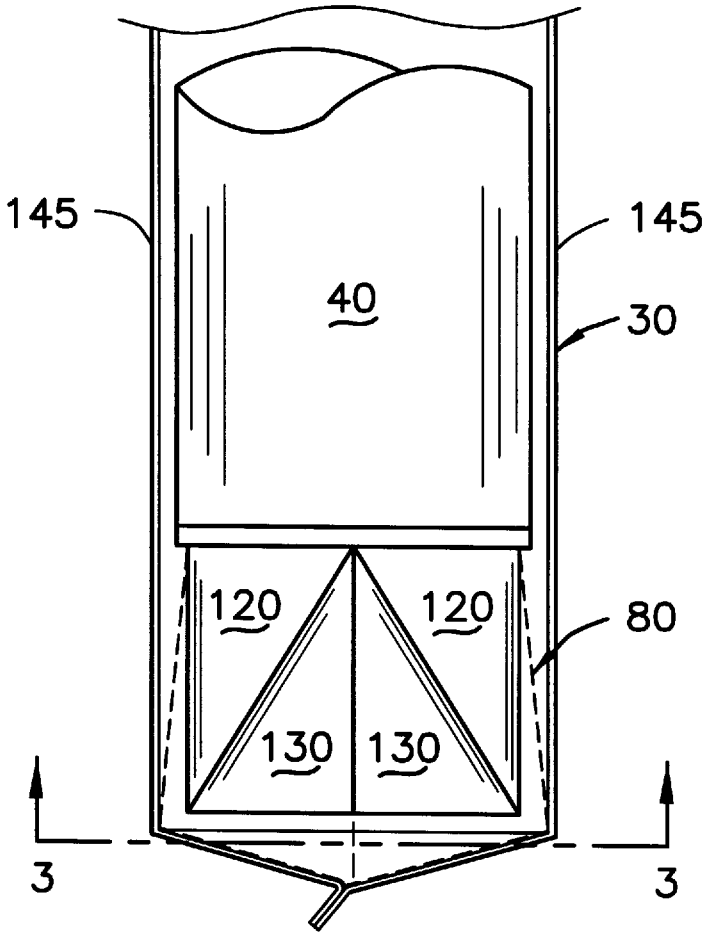
FIG. 4 is a perspective view of another embodiment of the disclosed filling nozzle.
Figure 5:
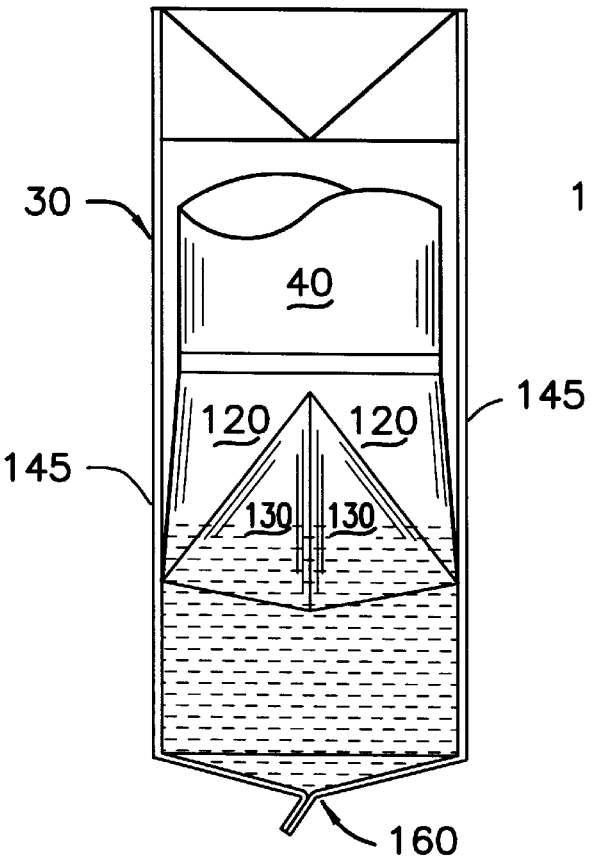
FIG. 5 is a side view of the filling nozzle FIG. 2 in its open position disposed in a carton with a cut-away of the carton.
Figure 6:
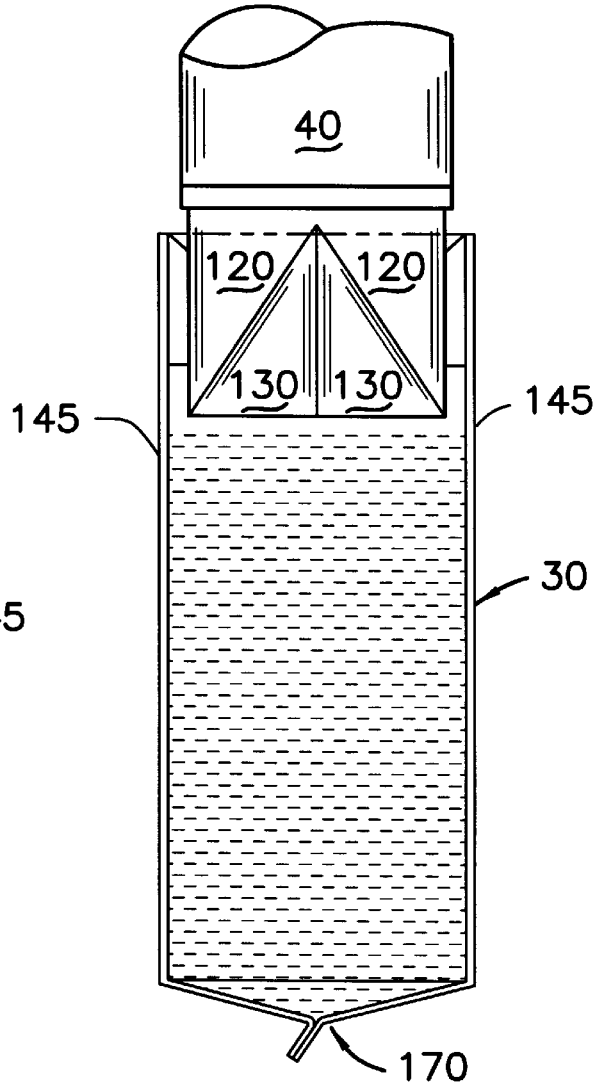
FIG. 6 is a side view of the filling nozzle of FIG. 2 in its collapsed position disposed in a carton.

The advantages of the foregoing nozzle construction are exemplified in the filling process illustrated in FIGS. 4–6. In the exemplary filling process, the bottom portion 160 of the container 30 and the nozzle 80 are brought proximate one another while the nozzle 80 is in a closed state. The flaps 130 are then urged to the open state by, for example, the pressure of the liquid product against the flaps as produced by the pump mechanism 75 and/or gravity. Alternatively, an opening mechanism that directly engages the flaps to urge them to an open state may be employed, such as the aforementioned movable plunger. Still further, the flaps 130 may be provided with electrically sensitive supports disposed therein or thereon that change shape in response to an electrical stimulus to thereby urge the flaps to their open and/or closed states.

The position of the flaps 130 in the open state are shown in phantom in FIGS. 3 and 4. As shown, the flaps 130 conform to and engage the sidewalls 145 of the container 30 to thereby form a seal with the sidewalls 145 that is sufficient to inhibit mixing between the liquid product and the ambient gas, such as air, during subsequent filling.

Product begins to be dispensed when the nozzle 80 and container 30 are in the relative position shown in FIG. 4. As product is dispensed into the container, the nozzle 80 and container 30 are moved relative to one another by, for example, the foregoing lifter mechanism 100 to thereby begin extracting the nozzle 80 from engagement with the interior of the container 30 during filling. During this extraction and filling process, the flaps 130 preferably remain in their open state and the motion profile used to cause the disengagement is preferably controlled to maintain the lower end of the nozzle 80 at a level below the liquid product surface (see FIG. 5). Ultimately, as shown in FIG. 6, the container 30 is filled with the desired volume of product and the flaps 130 go to their closed state. To reduce the likelihood that a further amount of product will drip into the container 30, the pump mechanism 75 may provide a slight backpressure that assists in retaining the flaps 130 in their closed state.

In the illustrated embodiment, the container 30 is shown in an intermediate state in which the bottom has been sealed to form a gabled bottom structure. Other bottom structures, however, may be utilized as well.

Without limitation, and with reference again to FIGS. 2 and 3, the container 30 may have sidewalls 145 defining a cross-section of 70 mm×70 mm. In such instance, the dimension L1 (see FIG. 2) is preferably about 35 mm.

Figure 7:
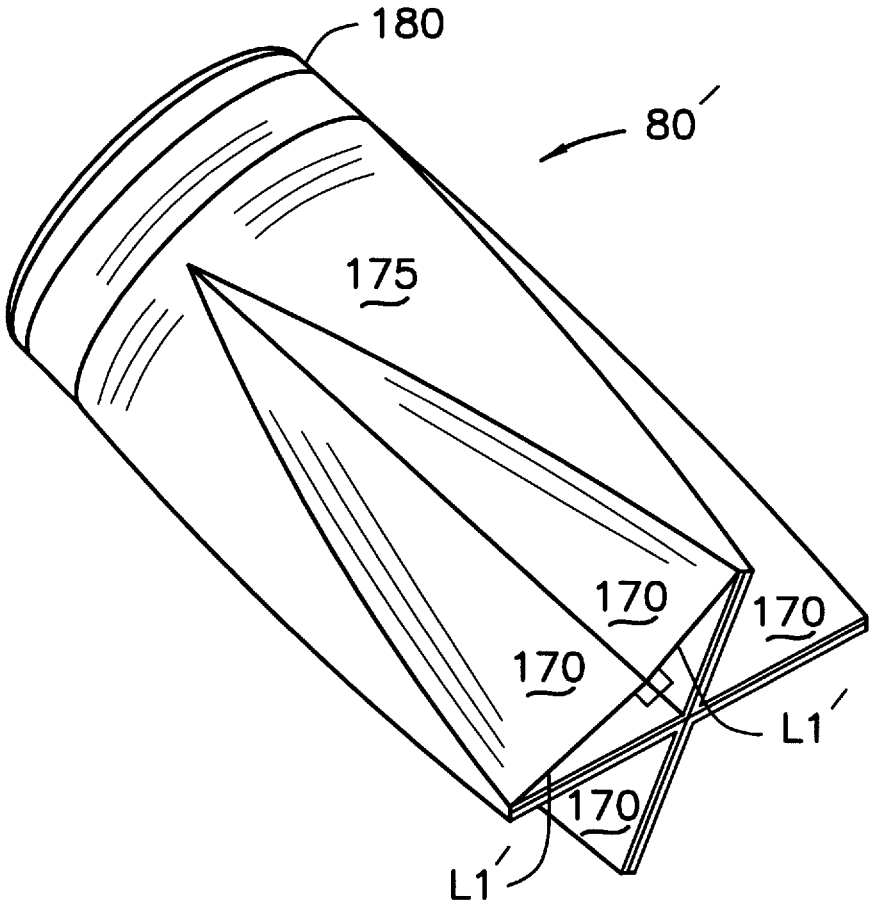
FIG. 7 is a perspective view of another embodiment of the filling nozzle which is dimensioned for use with a carton having a different cross-section.

FIG. 7 illustrates a further embodiment of a nozzle 80' suitable for use in the foregoing fill system. In this embodiment, the nozzle 80' has been designed to fill a container having sidewalls defining a cross-section, such as, without limitation, a 47 mm×47 mm container. Accordingly, the length L1' of FIG. 7 is about 23.5 mm. It is apparent from FIG. 7 that the nozzle is elongated compared to the embodiment of FIG 2. This elongation makes the nozzle particularly adapted to fill smaller cross-section containers. The elongated design reduces the stiffness of the flaps and lugs when compared to a shorter nozzle of the same material and is preferred when the carton has a small cross-section.

Figure 8:
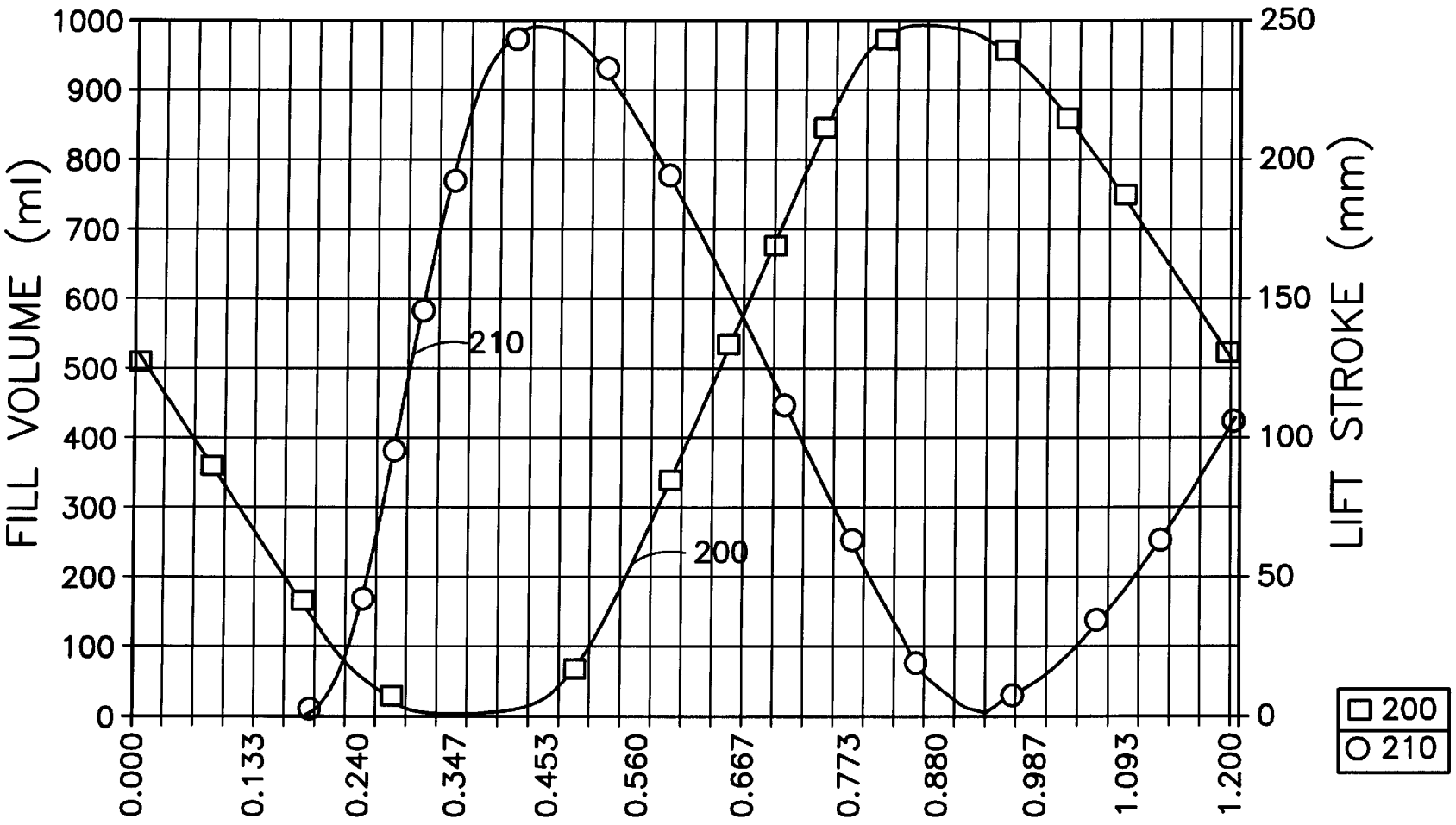
FIG. 8 is a graph of one motion profile that may be used in connection with the disclosed apparatus and method.

FIG. 8 is a graph of one of many motion profiles that may be used in accordance with the disclosed apparatus and method. More particularly, FIG. 8 shows the timing relationships between the pumping cycle of the pump mechanism 75, the volume of product in the container, and the position of the container with respect to the bottom of the nozzle 80, for a 70 cm×70 cm cross-section, 1000 milliliter volume package, using a filling velocity of 3300 ml./second. The right Y-axis represents the level of the container 30 in millimeters with zero being the lowest level of the container after it has been filled (i.e., in the conveyor). The left Y-axis represents fill volume in milliliters. Line 200 represents the cycle of the pumping mechanism 75. As shown (and as applied to the filling process shown in FIG. 1), the pump mechanism 75 is initially in a suction cycle, at which time it draws product 55 from the tank 50, from time 0 until about 0.375 seconds. Then the pump mechanism 75 begins its dispensing cycle at which time it dispenses the product 55 from the chamber 82 into the container 30 through nozzle 80. The pump mechanism 75 completes its dispensing cycle at approximately 0.855 seconds. Thereafter, the pump mechanism 75 begins a new suction cycle. The line 210 represents the level to which the container 30 is lifted by the lifter mechanism 100. As shown by line 210, the container 30 is lowered with respect to the bottom of the nozzle 80 as it is filled with product 55. In this manner, the lower end of the nozzle 80 remains below the rising level of product 55 as the container 30 is filled, thereby inhibiting frothing of the product 55 such as that caused through the mixing of air and product.

Figure 9:
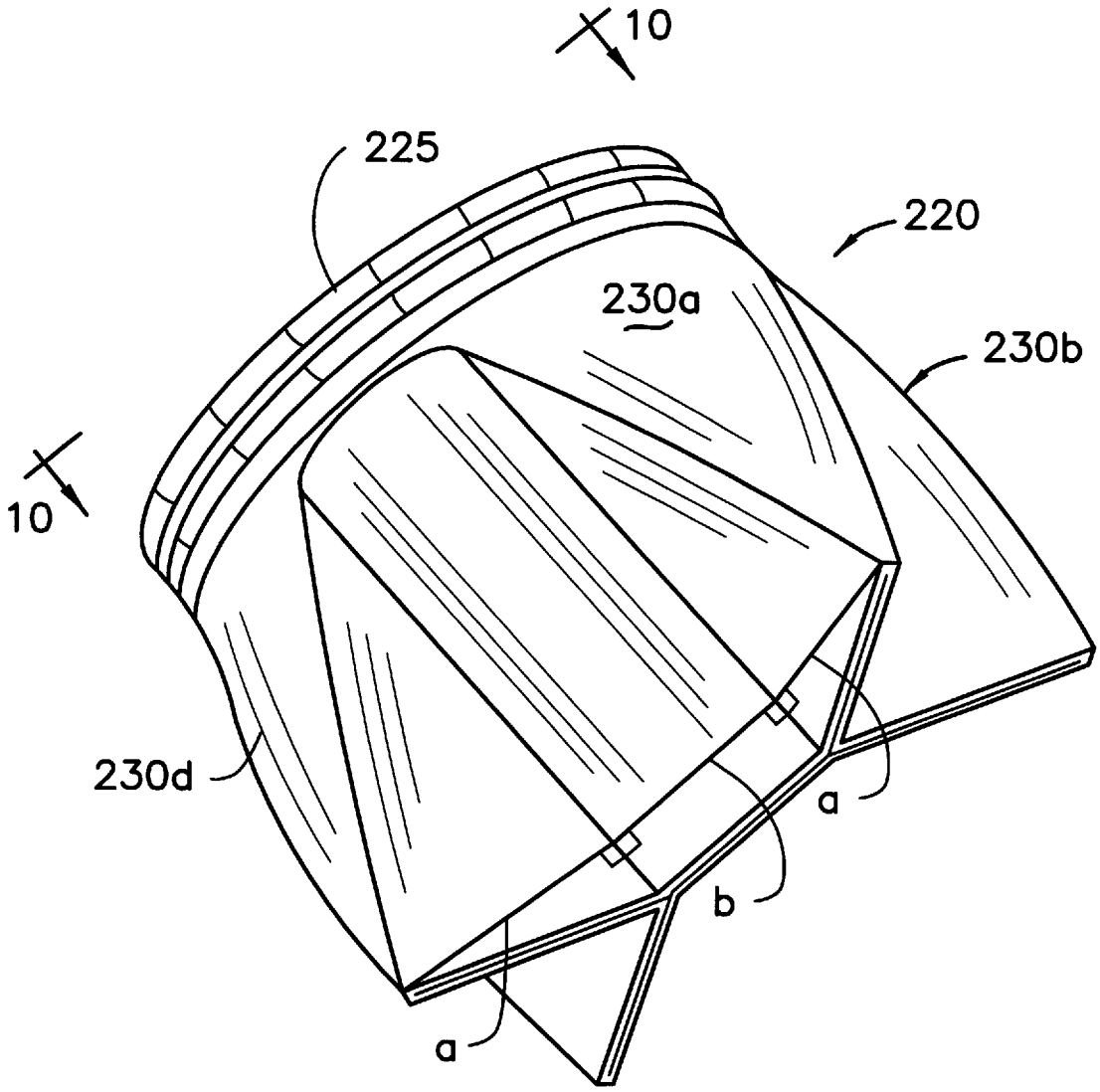
FIG. 9 is a perspective view of another embodiment of the disclosed filling nozzle for use in filling packages having a rectangular shape.
Figure 10:
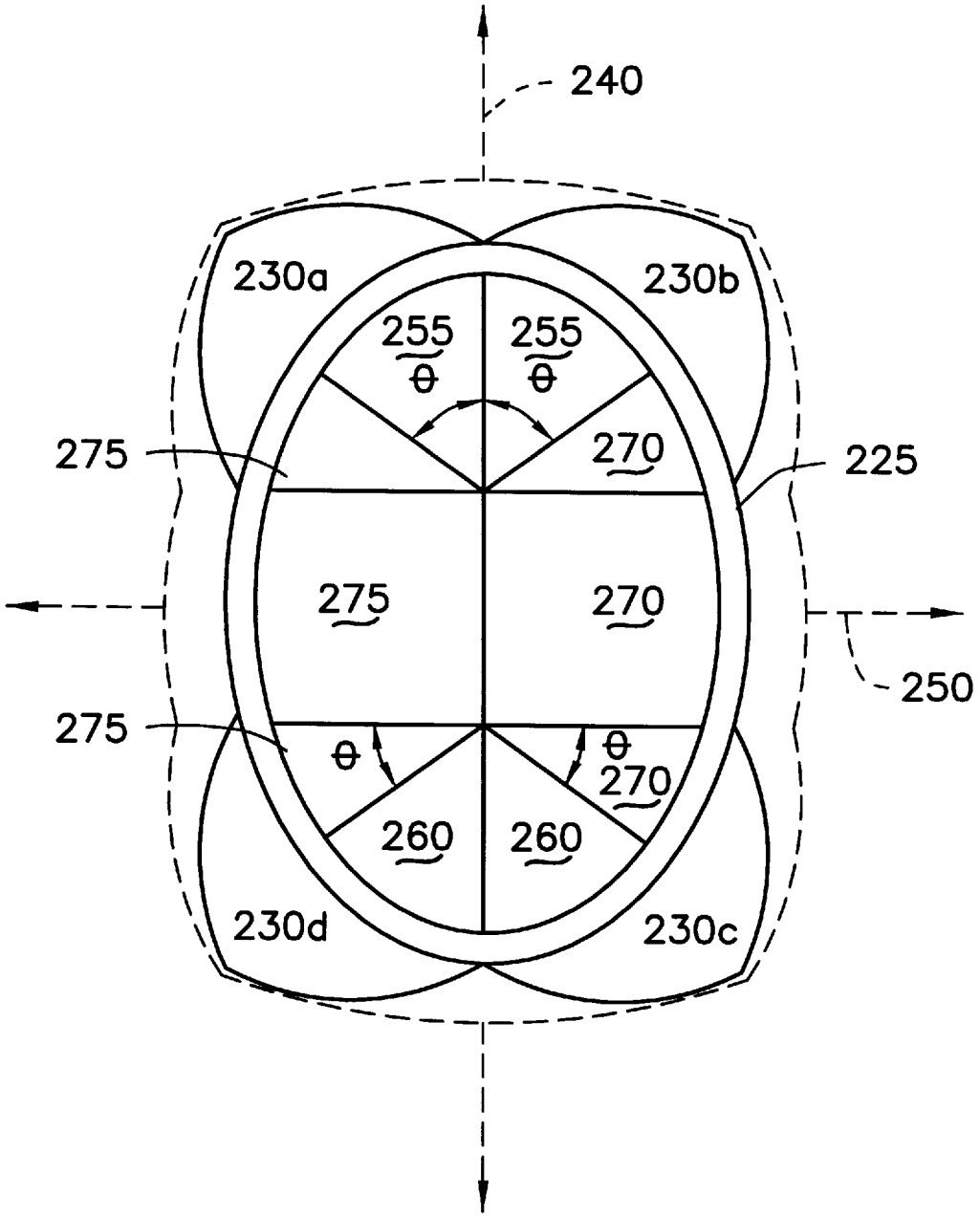
FIG. 10 is a top plan view of the nozzle of FIG. 9 showing the position of its various elements in both the open and closed positions.

FIGS. 9 and 10 show a perspective and planar view of another embodiment of the disclosed nozzle for use in filling packages having a rectangular shaped cross-section. The nozzle 220 is shown in its closed state in FIGS. 9 and 10 and in its open state in phantom in FIG. 10.

As illustrated, the nozzle 220 includes a collar portion 225 and a plurality of flaps and lugs extending from the collar portion 225. The collar 225 is of a substantially oval shape to accommodate an oval-shaped fill pipe outlet. A plurality of flaps and lugs extend from the collar 225. In the disclosed embodiment, there are four V-shaped lugs 230*a–d*. V-shaped lugs 230*a* and 230*b* are adjacent one another on opposite sides of major axis 240 and are preferably at a 45 degree angle θ with respect to the major axis 240. V-shaped lugs 230*c* and 230*d* are adjacent one another on opposite sides of major axis 240 and are each, likewise, preferably at a 45 degree angle with respect to the major axis 240. V-shape lugs 230*a* and 230*b* are disposed on a side of minor axis 250 opposite from V-shaped lugs 230*c* and 230*d*. Inwardly directed, inverted V-shaped flaps 255 connect adjacent V-shaped lugs 230*a* and 230*b* while inwardly directed, inverted V-shaped flaps 255 connect adjacent V-shaped lugs 230*c* and 230*d*. Non-adjacent V-shaped lugs 230*b* and 230*c* are connected with one another by an inwardly directed tri-panel flap 270 while non-adjacent V-shaped lugs 230*a* and 230*d* are connected with one another by a further inwardly directed tri-panel flap 275. By way of example, if the nozzle 220 is designed to fill a 70 mm×95 mm rectangular container, the length "a" is preferably about 35 mm in length (or ½ of the width of the container to be filled), and length "b" may be about 25 mm in length (or the difference between the length of the longer container sidewall and 2*a). As illustrated in phantom in FIG. 10, the nozzle 220 opens to a generally rectangular cross-section that can engage the sidewalls of a rectangular container to reduce the mixing of product and air during container filling. A fill system employing the embodiment of the nozzle of FIGS. 9 and 10 may be operated in accordance with the foregoing description provided in connection with FIGS. 4–6 and 8.

It will be understood that the nozzles of the present invention may take on any number of different forms which may substantially conform to the cross-sectional area of the container to be filled when the flaps are in an open position. For example, the container cross-sections may be hexagonal, octagonal, round, etc., the illustrated embodiments being merely exemplary.

Although the present invention has been described with reference to only a limited number of embodiments, those of skill in the art will recognize that changes may be made thereto without departing from the scope and spirit of the invention as set forth in the appended claims.

I claim:

1. A nozzle for use with packaging machines for filling packages that have sidewalls defining a cross-sectional, the nozzle comprising:

a collar for connecting the nozzle to the packaging machine; and a plurality of flaps formed from a flexible material extending from the collar, the flaps being dimensioned to substantially seal with the sidewalls of the container to be filled when the flaps are in an open state to thereby inhibit mixing of air and liquid product during filling of the container, wherein the plurality of flaps conform to a container having a cross-sectional area selected from the group of octagonal cross-section, hexagonal cross-section and round cross-section.

2. A nozzle for use with packaging machines for filling containers that have sidewalls, adjacent sidewalls joining together at corner sections and defining a cross-sectional area of each container, the nozzle comprising:

a collar for connecting the nozzle to the packaging machine; and a plurality of V-shaped lugs formed from a flexible material extending from the collar, the V-shaped lugs each having a side corner portion having vertices spaced at comers that are disposed for alignment with the corner sections of the container, adjacent V-shaped lugs being joined to one another by inwardly turned flaps, the V-shaped lugs and inwardly turned flaps being dimensioned to substantially seal with the sidewalls of the container to be filled when the V-shaped lugs and inwardly turned flaps are in an open state to thereby inhibit mixing of air and liquid product during filling of the container.

3. A nozzle as claimed in claim 2, wherein the nozzle comprises four V-shaped lugs for alignment with the corner sections of a rectangular container.

4. A nozzle as claimed in claim 2, wherein the nozzle comprises four V-shaped lugs for alignment with the corner sections of a square container.

5. A nozzle as claimed in claim 2, wherein the nozzle comprises six V-shaped lugs for alignment with the corner sections of a hexagonal container.

6. A nozzle as claimed in claim 2, wherein the nozzle comprises eight V-shaped lugs for alignment with the corner sections of an octagonal container.

7. A nozzle as claimed in claim 5, wherein the inwardly turned flaps have a length substantially equal to ½ of the length of a sidewall of the container, the length being measured along a perpendicular from the vertex of an adjacent V-shaped lug to an edge of the inwardly turned flap.

8. A filling system of a packaging machine comprising:

a container having a cross section defined by a plurality of sidewalls, an interior bottom engaging the sidewalls, and an open top;

a fill pump for pumping a liquid product;

a fill pipe having an inlet receiving liquid under pressure from the fill pump and an outlet overlying the container;

a nozzle disposed over the outlet end of the fill pipe, the nozzle comprising a collar for connecting the nozzle to the outlet end of the fill pipe and a plurality of flaps formed from a flexible material and extending from the collar, the plurality of flaps being biased to a closed state, the nozzle sealing the outlet end of the fill pipe when in the closed state;

moving means for relatively moving the container and nozzle toward one another to a first position in which the nozzle is disposed in the interior bottom of the container and a second position in which the nozzle is disposed distal from the interior bottom of the container;

the fill pump operating to pump the liquid product through the fill pipe under pressure when the container and nozzle are disposed in their relative first position to thereby urge the flaps of the nozzle from the closed state to an open state, the flaps of the nozzle being dimensioned to substantially conform and seal with the sidewalls of the container when the flaps are urged to the open state to thereby inhibit mixing of air and product as liquid product is dispensed into the container through the nozzle and the moving means is operated to relatively move the container and nozzle from the first position to the second position.

9. A filling system as claimed in claim 8 wherein the flaps are dimensioned to seal substantially with the sidewalls of the container at the engagement between the sidewalls and bottom of the container when the container and nozzle are in the first position and the nozzle is in the open.

10. A filling system as claimed in claim 9 wherein the container sidewalls define a square cross-section.

11. A filling system as claimed in claim 9 wherein the container sidewalls define a rectangular cross-section.

12. A filling system as claimed in claim 8 wherein the container sidewalls define a square cross-section.

13. A filling system as claimed in claim 12 wherein the container sidewalls define a 70 mm×70 mm cross-section.

14. A filling system as claimed in claim 12 wherein the container sidewalls define a 70 mm×95 mm cross-section.

15. A filling system as claimed in claim 8 wherein the container sidewalls define a rectangular cross-section.

16. A filling system as claimed in claim 8 wherein the plurality of flaps comprise:

first, second, third, and fourth, V-shaped lugs, each having a side corner portion, the V-shaped;

a first inwardly turned, inverted V-shaped portion extending between the side corner portions of the first and second V-shaped lugs;

a second inwardly turned, inverted V-shaped portion extending between the side corner portions of the second and third V-shaped lugs;

a third inwardly turned, inverted V-shaped portion extending between the side corner portions of the third and fourth V-shaped lugs;

a fourth inwardly turned, inverted V-shaped portion extending between the side corner portions of the fourth and first V-shaped lugs.

17. A filing system as claimed in claim 16 wherein the V-shaped lugs are disposed at about 90 degree intervals about a circle having a diameter of about 70 mm measured about a bottom portion of the nozzle.

18. A filling system as claimed in claim 16 wherein the V-shaped lugs flare inwardly from the bottom portion of the nozzle to an upper portion of the nozzle proximate the collar.

19. A filling system as claimed in claim 17 wherein the V-shaped lugs have a length of about 49 mm when the nozzle is in the closed position.

20. A filling system as claimed in claim 8 wherein the plurality of flaps comprise:

first, second, third, and fourth, V-shaped lugs, each having a side corner portion having vertices spaced at corners defining a rectangle;

a first inwardly turned tri-panel flap extending between the side corner portions of the first and second V-shaped lugs;

a second inwardly turned tri-panel flap extending between the side corner portions of the third and fourth V-shaped lugs;

a first inwardly turned, inverted V-shaped, dual-panel flap extending between the side corner portions of the first and fourth V-shaped lugs;

a second inwardly turned, inverted V-shaped, dual-panel extending between the side corner portions of the second and third V-shaped lugs.

21. A filling system as claimed in claim 1 wherein the container has an octagonal cross-section.

22. A filling system as claimed in claim 8 wherein the container has a hexagonal cross-section.

23. A filling system as claimed in claim 8 wherein the container has a round cross-section.

24. A method for filling a container comprising:

providing a container beneath a fill pipe of a filling machine, the container having sidewalls defining a predetermined cross-section;

bringing a bottom portion of the container and a nozzle that is disposed at an end of a fill pipe proximate one another, the nozzle comprising a plurality of flaps movable between a closed state in which it seals an end of the fill pipe and an open state;

pumping a liquid product through the fill pipe;

urging the plurality of flaps of the nozzle to an open position in which the flaps substantially conform to the sidewalls of the container to thereby allow product to be dispensed into the container while minimizing mixing of air and liquid product.

25. A method as claimed in claim 24 and further comprising the step of moving the bottom of the container and the nozzle away from one another as the container is filled with the liquid product, the movement being controlled to maintain a lower end of the nozzle below a level of the liquid product in the container.

26. A method as claimed in claim 24 wherein the step of providing is further defined by providing a container having sidewalls defining a square cross-section.

27. A method as claimed in claim 24 wherein the step of providing is further defined by providing a container having sidewalls defining a rectangular cross-section.

* * * * *